US008109111B2

(12) United States Patent
Yamada

(10) Patent No.: US 8,109,111 B2
(45) Date of Patent: Feb. 7, 2012

(54) REFRIGERATING APPARATUS HAVING AN INTERMEDIATE-PRESSURE REFRIGERANT GAS-LIQUID SEPARATOR FOR PERFORMING REFRIGERATION CYCLE

(75) Inventor: Masahiro Yamada, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 857 days.

(21) Appl. No.: 12/087,871

(22) PCT Filed: Jan. 11, 2007

(86) PCT No.: PCT/JP2007/050227

§ 371 (c)(1),
(2), (4) Date: Jul. 16, 2008

(87) PCT Pub. No.: WO2007/083560

PCT Pub. Date: Jul. 26, 2007

(65) Prior Publication Data

US 2010/0154451 A1 Jun. 24, 2010

(30) Foreign Application Priority Data

Jan. 19, 2006 (JP) ..... 2006-011287

(51) Int. Cl.
*F25B 27/00* (2006.01)

(52) U.S. Cl. ..... 62/324.1; 62/510

(58) Field of Classification Search ..... 62/117, 62/234, 238.7, 278, 324.1, 510, 512, 513, 62/80, 151

See application file for complete search history.

(56) References Cited

U.S. PATENT DOCUMENTS

| | | | | |
|---|---|---|---|---|
| 2,938,362 | A * | 5/1960 | Schwind | 62/149 |
| 3,130,558 | A * | 4/1964 | Gardner | 62/197 |
| 4,454,725 | A * | 6/1984 | Cann | 62/117 |
| 4,624,114 | A * | 11/1986 | Sakuma et al. | 62/502 |
| 5,191,776 | A * | 3/1993 | Severance et al. | 62/513 |
| 5,309,733 | A * | 5/1994 | Hayashida et al. | 62/278 |
| 5,570,585 | A * | 11/1996 | Vaynberg | 62/175 |
| 6,178,761 | B1 * | 1/2001 | Karl | 62/159 |

(Continued)

FOREIGN PATENT DOCUMENTS

JP 10-253207 A 9/1998

(Continued)

*Primary Examiner* — Mohammad Ali
(74) *Attorney, Agent, or Firm* — Birch, Stewart, Kolasch & Birch, LLP

(57) ABSTRACT

An optional unit (30) including a high pressure side compressor (31) and a gas-liquid separator (33) is provided between an outdoor unit (20) including a low pressure side compressor (21) and an indoor unit (40). During a defrosting operation, refrigerant discharged from the low pressure side compressor (21) defrosts an outdoor heat exchanger (21) while refrigerant in the gas-liquid separator (33) is sucked into the high pressure side compressor (31) and is then discharged to the suction side of the low pressure side compressor (21). The optional unit (30) includes an injection pipe (36) for returning part of the refrigerant discharged from the high pressure side compressor (31) to the suction side of the high pressure side compressor (31) in the defrosting operation. Hence, the refrigerant flowing into the high pressure side compressor (31) from the gas-liquid separator (33) is gasified by the high-temperature discharged refrigerant.

7 Claims, 8 Drawing Sheets

U.S. PATENT DOCUMENTS

| | | | | |
|---|---|---|---|---|
| 6,460,357 | B1 * | 10/2002 | Doi et al. | 62/199 |
| 6,722,156 | B2 * | 4/2004 | Tanimoto et al. | 62/510 |
| 6,923,016 | B2 | 8/2005 | Funakoshi et al. | |
| 7,096,679 | B2 * | 8/2006 | Manole | 62/115 |
| 2004/0134225 | A1 | 7/2004 | Sakamoto et al. | |
| 2006/0123835 | A1 * | 6/2006 | Takegami et al. | 62/498 |
| 2006/0266074 | A1 * | 11/2006 | Groll et al. | 62/510 |

FOREIGN PATENT DOCUMENTS

| | | | |
|---|---|---|---|
| JP | 2001-56159 | A | 2/2001 |
| JP | 2001-263882 | A | 9/2001 |
| JP | 200-349629 | A | 12/2001 |
| JP | 2003-65616 | A | 3/2003 |
| JP | 2004-251492 | A | 9/2004 |

* cited by examiner

REFRIGERATING APPARATUS HAVING AN INTERMEDIATE-PRESSURE REFRIGERANT GAS-LIQUID SEPARATOR FOR PERFORMING REFRIGERATION CYCLE

TECHNICAL FIELD

The present invention relates to refrigerating apparatuses and particularly relates to a refrigerating apparatus performing a two-stage compression/two-stage expansion refrigeration cycle using intermediate-pressure refrigerant gas-liquid separator.

BACKGROUND ART

There are conventionally known refrigerating apparatuses and hot-water suppliers performing a refrigeration cycle in a refrigerant circuit. For example, Patent Document 1 discloses an air conditioner as a refrigerating apparatus performing indoor cooling and heating by circulating refrigerant reversibly in a refrigerant circuit.

Specifically, the air conditioner in Patent Document 1 performs, through switching of a four-way switching valve, a cooling cycle in which refrigerant discharged from a compressor flows into an outdoor heat exchanger in cooling operation and a heating cycle in which refrigerant discharged from the compressor flows into an indoor heat exchanger in a heating operation. Further, in this air conditioner, when the outdoor heat exchanger is frosted in the heating operation, the heating cycle is switched to the cooling cycle to defrost the outdoor heat exchanger by high-temperature hot gas, which is generally called a reverse cycle defrosting operation.

Patent Document 1: Japanese Unexamined Patent Application Publication 10-253207

SUMMARY OF THE INVENTION

Problems that the Invention is to Solve

In view of global environment conservation and the like, natural refrigerant, such as carbon dioxide and the like are employed as the refrigerant recently. The use of carbon dioxide means, however, compression thereof up to its critical pressure. This increases the compression ratio of the compressor, thereby resulting in application of severe burden to the compressor. To tackle this problem, namely, to reduce the burden to the compressor and to increase the driving efficiency of the compressor, there has been conventionally employed a generally called two-stage compression/two-stage expansion refrigeration cycle in which a low pressure side compressor and a high pressure side compressor are provided in series and intermediate-pressure refrigerant gas-liquid separator is provided for injecting gas refrigerant in the gas-liquid separator into the suction side of the high pressure side compressor.

Consider herein the case where in the aforementioned existing air conditioner, the refrigerant is changed to carbon dioxide and a high pressure side compressor and a gas-liquid separator are retrofitted for performing the two-stage compression/two-stage expansion refrigeration cycle, for example, in the heating cycle. In this case, a communication gas pipe is provided between the four-way switching valve and the indoor heat exchanger so that the high pressure side compressor sucks the refrigerant discharged from the existing low pressure side compressor in the heating cycle. The gas-liquid separator is provided in a communication pipe between the indoor heat exchanger and the outdoor heat exchanger and is connected to an injection pipe for injecting the gas refrigerant into the suction side of the high pressure side compressor. According to the relationship between the amount of the gas refrigerant injected and the amount of the refrigerant that the high pressure side compressor sucks, the volume of the high pressure side compressor is set smaller than that of the low pressure side compressor in general.

In the heating cycle in the above case, the refrigerant discharged from the low pressure side compressor is sucked into the high pressure side compressor via the four-way switching valve to be compressed in two stages and flows then into the indoor heat exchanger to be condensed. On the other hand, the gas refrigerant in the gas-liquid separator flows into the suction side of the high pressure side compressor. The liquid refrigerant in the gas-liquid separator flows into the outdoor heat exchanger to be evaporated, is sucked into the low pressure side compressor, and is then discharged again. While in the cooling cycle, the refrigerant discharged from the existing low pressure side compressor flows into the outdoor heat exchanger via the four-way switching valve to be condensed, and the thus condensed liquid refrigerant flows into the indoor heat exchanger via the gas-liquid separator to be evaporated. Namely, during the cooling cycle, the suction side of the high pressure side compressor does not communicate with the low pressure side compressor but communicates only with the gas-liquid separator. This might involve, in driving the high pressure side compressor in addition in the cooling cycle, generally called wet vapor suction that the liquid refrigerant in the gas-liquid separator is sucked into the high pressure side compressor.

For this reason, it is difficult to drive the high pressure side compressor in the cooling cycle. Accordingly, only the low pressure side compressor can be driven in the reverse cycle defrosting operation in spite of the high pressure side compressor provided. This leads to insufficient exertion of the defrosting capacity to elongate time required for defrosting. As a result, the comfortableness in the heating operation is lost.

The present invention has been made in view of the foregoing and has its object of driving, in a refrigerating apparatus to which a high pressure side compressor and a gas-liquid separator are retrofitted for enabling a two stage compression/two stage expansion refrigeration cycle in a heating operation, both compressors in a defrosting operation in a cooling cycle with wet vapor suction by the high pressure side compressor from the gas-liquid separator prevented.

Means for Solving the Problems

A first aspect of the present invention premises a refrigerating apparatus including a refrigerant circuit (15) including a low pressure side compressor (21), a high pressure side compressor (31), and an intermediate-pressure refrigerant gas-liquid separator (33) for performing two-stage compression/two-stage expansion refrigeration cycle, wherein the refrigerant circuit (15) is switched from/to a heating cycle to/from a defrosting cycle, refrigerant being subjected to the two-stage compression/tow-stage expansion in the heating cycle in which refrigerant discharged from the low pressure side compressor (21) is compressed in the high pressure side compressor (31) while condensed refrigerant flows into the gas-liquid separator (33) and gas refrigerant in the gas-liquid separator (33) is sucked into the high pressure side compressor (31), and the refrigerant being subjected to single-stage compression/single stage expansion in the defrosting cycle in which refrigerant discharged from the low pressure side compressor (21) and then condensed bypasses the gas-liquid separator (33) to flow while evaporated refrigerant bypasses the high pressure side compressor (31) to flow.

Further, in the first aspect, the refrigerant circuit (15) includes an injection pipe (36) for injecting part of refrigerant discharged from the high pressure side compressor (31) into a suction side of the high pressure side compressor (31) so as to merge the refrigerant with refrigerant from the gas-liquid separator (33).

In the above aspect, during the heating operation, the two stage compression/two stage expansion refrigeration cycle is performed and the intermediate-pressure refrigerant is separated into the liquid refrigerant and the gas refrigerant by the gas-liquid separator (33) in the refrigerant circuit (15). In the defrosting operation (reverse cycle defrosting operation), the single stage compression/single stage expansion refrigeration cycle is performed in the refrigerant cycle (15).

Specifically, during the heating operation, the refrigerant compressed up to high pressure in the high pressure side compressor (31) is condensed in an indoor heat exchanger as, for example, a user side heat exchanger, and is reduced in pressure up to the intermediate pressure, and flows then into the gas-liquid separator (33). In the gas-liquid separator (33), the intermediate-pressure refrigerant is separated into the liquid refrigerant and the gas refrigerant. The thus separate liquid refrigerant is reduced in pressure up to low pressure and is then evaporated in an outdoor heat exchanger as, for example, a heat source side heat exchanger. The thus evaporated refrigerant is compressed up to intermediate pressure in the low pressure side compressor (21), is sucked into the high pressure side compressor (31), and is then discharged again. This refrigerant circulation is repeated. On the other hand, the gas refrigerant separated in the gas-liquid separator (33) is mixed with the refrigerant discharged from the low pressure side compressor (21) and is then sucked into the high pressure side compressor (31).

On the other hand, during the defrosting operation, the low pressure side compressor (21) is driven with the high pressure side compressor (31) stopped, for example. In this case, the refrigerant compressed up to high pressure in the low pressure side compressor (21) is condensed in the outdoor heat exchanger to defrost the outdoor heat exchanger. The thus condensed refrigerant bypasses the gas-liquid separator (33), is reduced in pressure up to low pressure, and is then evaporated in the indoor heat exchanger. The thus evaporated refrigerant bypasses the high pressure side compressor (31), is sucked into the low pressure side compressor (21), and is then discharged again. This refrigerant circulation is repeated. While the discharge side of the high pressure side compressor (31) communicates with the suction side of the low pressure side compressor (21), the suction side of the high pressure side compressor (31) does not communicate with any of the discharge side and the suction side of the low pressure side compressor (21) but communicates with the gas-liquid separator (33).

When the high pressure side compressor (31) is driven in addition for increasing the defrosting capacity, the gas refrigerant in the gas-liquid separator (33) is sucked into the high pressure side compressor (31) and the refrigerant discharged from the high pressure side compressor (31) is mixed with the refrigerant evaporated in the indoor heat exchanger and is then sucked into the low pressure side compressor (21). Whereby, the enthalpy of the refrigerant increases by the work load (heat input) of the high pressure side compressor (31) in the refrigerant circuit (15), thereby increasing the defrosting capacity.

In the defrosting operation, however, not only the gas refrigerant but also the liquid refrigerant in the gas-liquid separator (33) may be sucked into the high pressure side compressor (31). If the liquid refrigerant is sucked thereto, the compressor may be broken. To tackle this problem, in this aspect of the present invention, part of the refrigerant discharged from the high pressure side compressor (31) is returned to the suction side of the high pressure side compressor (31) through the injection pipe (36). Whereby, the liquid refrigerant flowing out from the gas-liquid separator (33) is mixed with the high-temperature refrigerant discharged from the injection pipe (36) to be heated and gasified. Hence, the liquid refrigerant is prevented from flowing into the high pressure side compressor (31).

A second aspect of the present invention premises a refrigerating apparatus including a refrigerant circuit (15) including: a heat source unit (20) including a low pressure side compressor (21) and a heat source side heat exchanger (22); a user unit (40) including a user side heat exchanger (41); and an intermediate unit (30) including: a gas line (3G) in which a high pressure side compressor (31) is provided and which is connected between the heat source unit (20) and the user unit (40); and a liquid line (3L) in which an intermediate-pressure refrigerant gas-liquid separator (33) connected to a suction side of the high pressure side compressor (31) by means of a gas flow-out pipe (33*c*) is provided and which is connected between the heat source unit (20) and the user unit (40), the refrigerant circuit (15) being switched between a heating cycle and a defrosting cycle, refrigerant being compressed in two stages in the heating cycle in a way that refrigerant discharged from the low pressure side compressor (21) is compressed in the high pressure side compressor (31) in the gas line (3G) while liquid refrigerant from the user unit (40) flows into the gas-liquid separator (33) in the liquid line (3L), and the refrigerant being compressed in a single stage in the defrosting cycle in a way that the refrigerant flowing into the heat source side heat exchanger (22) from the low stage side compressor (21) bypasses the gas-liquid separator (33) in the liquid line (3L) to flow while gas refrigerant from the user unit (40) bypasses the high pressure side compressor (31) and the gas flow-out pipe (33*c*) in the gas line (3G) to flow.

In this aspect, the intermediate unit (30) includes an injection pipe (36) provided in the gas line (3G) for injecting part of refrigerant discharged from the high pressure side compressor (31) between a suction side of the high pressure side compressor (31) and the gas flow-out pipe (33*c*).

In the above aspect, the intermediate unit (30) is connected between the heat source unit (20) and the user unit (40) in the refrigerant circuit (15). The intermediate unit (30) serves as an extended unit for, for example, the existing heat source unit (20) and user side unit (40) to attain two stage compression/two stage expansion of the refrigerant in the heating operation for increasing the heating capacity.

During the heating operation, the refrigerant compressed up to high pressure in the high pressure side compressor (31) flows into the user unit (40) through the gas line (3G) and is condensed in the user side heat exchanger (41). The thus condensed refrigerant flows through the liquid line (3L) of the intermediate unit (30) to be reduced in pressure up to intermediate pressure and is then flows into the gas-liquid separator (33). In the gas-liquid separator (33), the intermediate-pressure refrigerant is separated into the liquid refrigerant and the gas refrigerant. The thus separated liquid refrigerant flows into the heat source unit (20) through the liquid line (3L) to be reduced in pressure up to low pressure and is then evaporated in the heat source side heat exchanger (22). The thus evaporated refrigerant is reduced in pressure up to intermediate pressure in the low pressure side compressor (21), flows through the gas line (3G) of the intermediate unit (30), and is then compressed up to high pressure again in the high pressure side compressor (31). This refrigerant circulation is repeated. On the other hand, the gas refrigerant separated in the gas-liquid separator (33) flows into the gas line (3G) through the gas flow-out pipe (33*c*), is mixed with the refrigerant discharged from the low pressure side compressor (21), and is then sucked into the high pressure side compressor (31). In short, the two stage compression/two stage expansion refrigeration cycle is performed in the refrigerant circuit (15) during the heating operation.

On the other hand, during the defrosting operation, the low pressure side compressor (21) is driven with the high pressure side compressor (31) stopped, for example. In this case, the refrigerant compressed up to high pressure in the low pressure side compressor (21) is condensed in the heat source side heat exchanger (22) to defrost the heat source side heat exchanger (21). The thus condensed refrigerant flows into the liquid line (3L) of the intermediate unit (30), while bypassing the gas-liquid separator (33), to flow into the user unit (40). This refrigerant is compressed up to low pressure, is evaporated in the indoor heat exchanger, and is then flows into the gas line (3G) of the intermediate unit (30). The refrigerant in the gas line (3G) bypasses the high pressure side compressor (31) and the gas flow-out pipe (33*c*) to flow into the heat source unit (20). The refrigerant flowing in the heat source unit (20) is compressed up to high pressure again in the low pressure side compressor (21). This refrigerant circulation is repeated. Namely, the discharge side of the high pressure side compressor (31) communicates with the suction side of the low pressure side compressor (21) while the suction side of the high pressure side compressor (31) does not communicate with any of the discharge side and the suction side of the low pressure side compressor (21) but communicates with the gas-liquid separator (33).

When the high pressure side compressor (31) is driven in addition for increasing the defrosting capacity, the gas refrigerant from the gas-liquid separator (33) is sucked into the high pressure side compressor (31) and the refrigerant discharged from the high pressure side compressor (31) is mixed with the evaporated refrigerant from the user side heat exchanger (41) at the gas line (3G) and is sucked into the low pressure side compressor (21). This increases the enthalpy of the refrigerant by the work load (heat input) of the high pressure side compressor (31) in the refrigerant circuit (15), thereby increasing the defrosting capacity.

In the defrosting operation, however, not only the gas refrigerant but also the liquid refrigerant in the gas-liquid separator (33) may be sucked into the high pressure side compressor (31). If the liquid refrigerant is sucked thereto, the compressor may be broken. To tackle this problem, in this aspect of the present invention, part of the refrigerant discharged form the high pressure side compressor (31) is allowed to flow into the suction side of the high pressure side compressor (31) through the injection pipe (36). Whereby, the liquid refrigerant flowing out from the gas flow-out pipe (33*c*) is mixed with the high-temperature refrigerant discharged from the injection pipe (36) to be heated and gasified. Hence, the liquid refrigerant is prevented from flowing into the high pressure side compressor (31).

Referring to a third aspect of the present invention, the intermediate unit (30) in the second aspect includes heating means (38) in the liquid line (3L) for heating refrigerant flowing into the gas-liquid separator (33).

In the above aspect, during the defrosting operation in which both the high pressure side compressor (31) and the low pressure side compressor (21) are driven, part of the liquid refrigerant flowing in the liquid line (3L) of the intermediate unit (30) from the heat source unit (20) flows into the gas-liquid separator (33) while the other refrigerant flows into the user unit (40). In other words, since the gas refrigerant from the gas-liquid separator (33) is sucked into the high pressure side compressor (31), part of the refrigerant in the liquid line (3L) of which amount is equal to that of the refrigerant sucked into the high pressure side compressor (31) is supplemented to the gas-liquid separator (33).

In the above state, the refrigerant flowing into the gas-liquid separator (33) is heated by the heating means (38) to be in gas-liquid two-phase state. Namely, the refrigerant is readily dried. This increases the amount ratio of the gas refrigerant to the entirety of the refrigerant in the gas-liquid separator (33). Accordingly, outflow of the liquid refrigerant from the gas-liquid separator (33) to the high pressure side compressor (31) is suppressed to prevent definitely the liquid refrigerant from being sucked into the high pressure side compressor (31).

Referring to a fourth aspect of the present invention, the intermediate unit (30) in the second aspect includes heating means (38) in the gas flow-out pipe (33*c*) for heating refrigerant flowing out from the gas-liquid separator (33).

In the above aspect, during the defrosting operation in which both the high pressure side compressor (31) and the low pressure side compressor (21) are driven, even the liquid refrigerant flowing out into the gas flow-out pipe (33*c*) from the gas-liquid separator (33) is heated and gasified by the heating means (38). Hence, the liquid refrigerant is prevented definitely from being sucked into the high pressure side compressor (31).

Referring to a fifth aspect of the present invention, the intermediate unit (30) in the second aspect includes heating means (39) at the gas-liquid separator (33) for heating refrigerant in the gas-liquid separator (33).

In the above aspect, during the defrosting operation in which both the high pressure side compressor (31) and the low pressure side compressor (21) are driven, the refrigerant in the gas-liquid separator (33) is heated by the heating means (39), so as to increase the amount ratio of the gas refrigerant in the gas-liquid separator (33). Hence, outflow of the liquid refrigerant from the gas-liquid separator (33) into the high pressure side compressor (31) is suppressed. As a result, the liquid refrigerant is prevented definitely from being sucked into the high pressure side compressor (31).

Referring to a sixth aspect of the present invention, the intermediate unit (30) in the fourth aspect includes a liquid branch pipe (33*e*) of which one end is connected to the liquid line (3L) and of which other end is connected upstream of the heating means (38) in the gas flow-out pipe (33*c*).

In the above aspect, during the defrosting operation in which both the high pressure side compressor (31) and the low pressure side compressor (21) are driven, part of the liquid refrigerant flowing into the liquid line (3L) of the intermediate unit (30) from the heat source unit (20) flows into the gas-liquid separator (33) while the other liquid refrigerant flows toward the user unit (40). Further, of the refrigerant flowing toward the user unit (40), part flows into the liquid branch pipe (33*e*) while the other flows into the user unit (40). The refrigerant flowing in the liquid branch pipe (33*e*) is merged with the refrigerant from the gas-liquid separator (33) at the gas flow-out pipe (33*c*) and is then heated by the piping heater (38).

Accordingly, the amount of the refrigerant flowing into the user side heat exchanger (41) decreases to increase the temperature of the refrigerant in the user side heat exchanger (41). This increases the temperature of the refrigerant sucked into the low pressure side compressor (21) to increase the temperature of the refrigerant discharged therefrom. Thus, the defrosting capacity increases.

Referring to a seventh aspect of the present invention, the refrigerant in the first or second aspect is carbon dioxide.

In the above aspect, though the carbon dioxide is compressed up to its critical pressure in the heating operation, the compression is done in two stages by the low pressure side compressor (21) and the high pressure side compressor (31). This reduces burden to the compressors.

Effects of the Invention

According to the present invention, in the defrosting operation in which the high pressure side compression (31) sucks the gas refrigerant from the gas-liquid separator (33) and discharges it to the suction side of the low pressure side compressor (21), part of the refrigerant discharged from the high pressure side compressor (31) is injected to the suction side thereof. Accordingly, even when the liquid refrigerant flows out from the gas-liquid separator (33) toward the high pressure side compressor (31), the liquid refrigerant can be gasified by the high-temperature discharged refrigerant. This prevents the liquid refrigerant from being sucked into the high pressure side compressor (31). As a result, both the low pressure side compressor (21) and the high pressure side compressor (31) can be driven in the defrosting operation, thereby increasing the defrosting capacity.

Further, in the third aspect, the heating means (38) is provided in the liquid line (3L) for heating the refrigerant flowing into the gas-liquid separator (33), so that the refrigerant flowing in the gas-liquid separator (33) is readily dried. This increases the amount ratio of the gas refrigerant in the gas-liquid separator (33) to prevent definitely the liquid refrigerant from being sucked into the high pressure side compressor (31).

In the fourth aspect, the heating means (38) is provided in the gas flow-out pipe (33*c*) for heating the refrigerant from the gas-liquid separator (33) to degasify the liquid refrigerant flowing out into the gas flow-out pipe (33*c*). This definitely prevents the liquid refrigerant from being sucked into the high pressure side compressor (33).

In the fifth aspect, the heating means (39) for heating the refrigerant in the gas-liquid separator (33) is provided to increase the amount ratio of the gas refrigerant in the gas-liquid separator (33). Hence, outflow of the liquid refrigerant from the gas-liquid separator (33) can be suppressed to prevent definitely the liquid refrigerant from being sucked into the high pressure side compressor (33).

In the sixth aspect, part of the refrigerant flowing through the liquid line (3L) toward the user unit (40) is allowed to flow into the gas flow-out pipe (33*c*), so that the amount of the refrigerant flowing into the user side heat exchanger (41) decrease to increase the temperature of the refrigerant in the user side heat exchanger (41). This increases each temperature of the refrigerant sucked into and discharged from the low pressure side compressor (21) to thus increase the defrosting capacity further.

Further in the seventh aspect, carbon dioxide used as the refrigerant is compressed up to its critical pressure. This is performed in two stages by the low pressure side compressor (21) and the high pressure side compressor (31) to thus reduce the burden to the respective compressors.

INDEX OF REFERENCE NUMERALS

Figure 1:
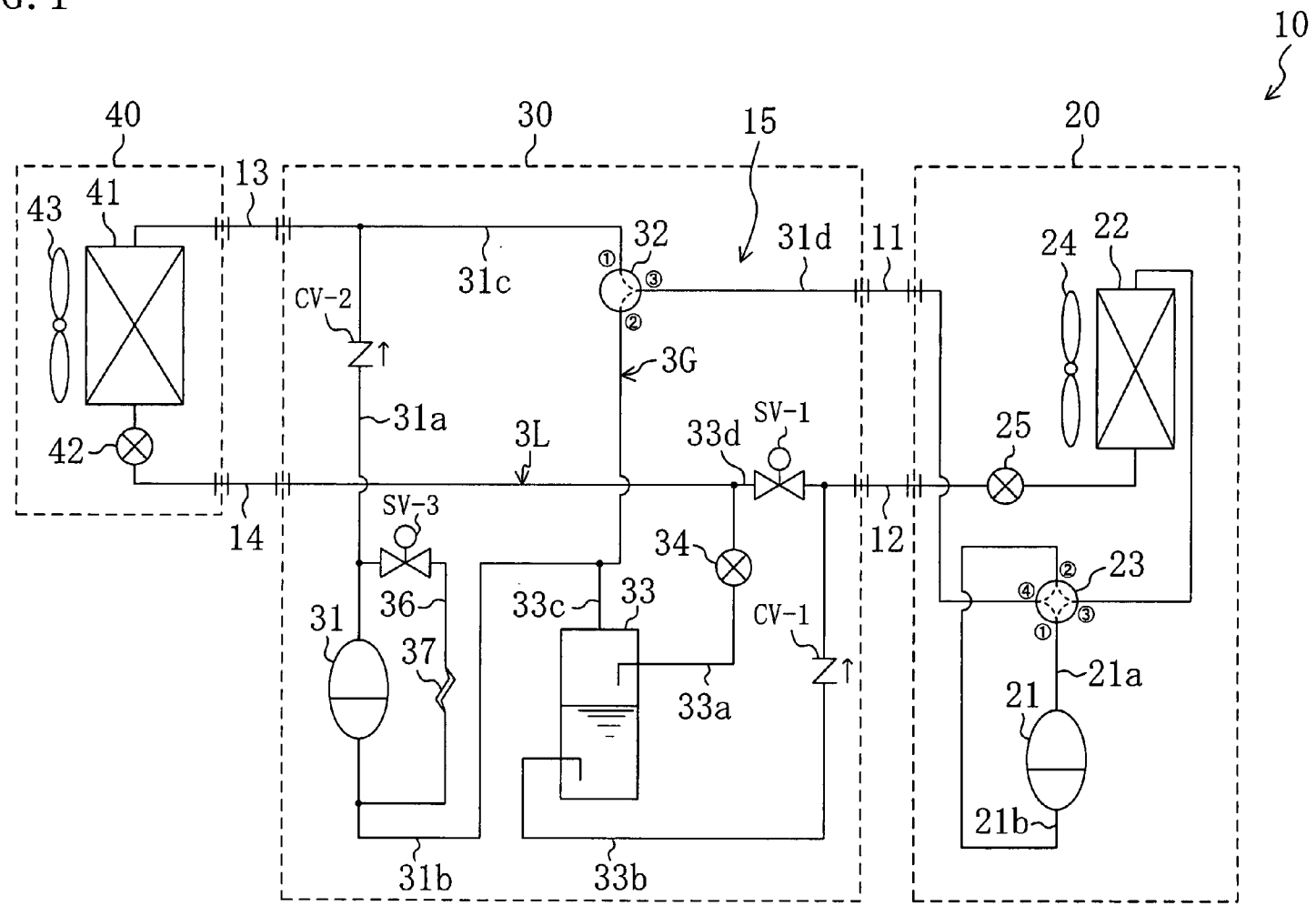
FIG. 1 is a refrigerant circuit diagram of an air conditioner in accordance with Embodiment 1.

10 air conditioner (refrigerating apparatus)
15 refrigerant circuit
20 outdoor unit (heat source unit)
21 low pressure side compressor
22 outdoor heat exchanger (heat source side heat exchanger)
30 optional unit (intermediate unit)
31 high pressure side compressor
33 gas-liquid separator
33*c* gas flow-out pipe
33*e* liquid branch pipe
36 injection pipe
38 piping heater (heating means)
39 gas-liquid separator heater (heating means)
40 indoor unit (user unit)
41 indoor heat exchanger (user side heat exchanger)
3G gas line
3L liquid line

BEST MODE FOR CARRYING OUT THE INVENTION

Embodiments of the present invention will be described below in detail with reference to the accompanying drawings.

Embodiment 1

A refrigerating apparatus of Embodiment 1 composes a heat pump type air conditioner (10) capable of performing a cooling operation, a heating operation, and a defrosting operation. As shown in FIG. 1, the air conditioner (10) includes an outdoor unit (20) installed outdoors, an optional unit (30) serving as an extended intermediate unit, and an indoor unit (40) installed indoors.

The outdoor unit (20) is connected to the optional unit (30) by means of a first communication pipe (11) and a second communication pipe (12). The outdoor unit (20) is connected to the optional unit (30) by means of a third communication pipe (13) and a fourth communication pipe (14). These units (20, 30, 40) are connected in this way to form a refrigerant circuit (15). A vapor compression refrigeration cycle is performed by circulating refrigerant in the refrigerant circuit (15).

The optional unit (30) serves as a power-up unit for an existing separate type air conditioner. Specifically, the existing air conditioner performs a single compression refrigeration cycle in a refrigerant circuit composed of the outdoor unit (20) and the indoor unit (40). By connecting the optional unit (30) between the outdoor unit (20) and the indoor unit (40), a two-stage compression/two-stage expansion refrigeration cycle can be performed in the refrigerant circuit (15) of the air conditioner (10), which will be described later.

<Outdoor Unit>

The outdoor unit (20) includes a low pressure side compressor (21), an outdoor heat exchanger (22), an outdoor unit expansion valve (25), and a four-way switching valve (23).

The low pressure side compressor (21) is composed of a variable capacity scroll compressor of high-pressure dome type. The outdoor heat exchanger (22) is composed of a fin-and-tube heat exchanger of cross-fin type. An outdoor fan (24) is provided in the vicinity of the outdoor heat exchanger (22). The outdoor fan (24) sends the outdoor air to the outdoor heat exchanger (22). The outdoor unit expansion valve (25) is composed of an electronic expansion valve of which opening is adjustable.

The four-way switching valve (23) includes first to fourth ports. In the four-ways witching valve (23), the first port is connected to a discharge pipe (21*a*) of the low pressure side compressor (21), the second port is connected to a suction pipe (21*b*) of the low pressure side compressor (21), the third port is connected to the second communication pipe (12) via the outdoor heat exchanger (22) and the outdoor unit expansion valve (25), and the fourth port is connected to the first communication pipe (11). The four-way switching valve (23) is exchanged between a state in which the first and third ports communicate with each other while the second and fourth ports communicate with each other and a state in which the first and fourth ports communicate with each other while the second and third ports communicate with each other.

<Indoor Unit>

The indoor unit (40) includes an indoor heat exchanger (41) and an indoor unit expansion valve (42). The indoor heat exchanger (41) is connected at one end thereof to the third communication pipe (13) while being connected at the other end thereof to the fourth communication pipe (14) via the indoor unit expansion valve (42). The indoor heat exchanger (41) is composed of a fin-and-tube heat exchanger of cross-fin type. An indoor fan (43) is provided in the vicinity of the indoor heat exchanger (41). The indoor fan (43) sends the indoor air to the indoor heat exchanger (41). The indoor unit expansion valve (42) is composed of an electronic expansion valve of which opening is adjustable.

<Optional Unit>

The optional unit (30) includes a high pressure side compressor (31), a three-way switching valve (32), a gas-liquid separator (33), and an optional unit expansion valve (34).

The high pressure side compressor (31) is composed of a variable capacity scroll compressor of high-pressure dome type. A discharge pipe (31*a*) of the high pressure side compressor (31) is connected to the third communication pipe (13) extending from the indoor unit (40). A suction pipe (31*b*) of the high pressure side compressor (31) is connected to the three-way switching valve (32). In the present embodiment, the volume of the high pressure side compressor (31) is set smaller than that of the low pressure side compressor (21).

The three-way switching valve (32) includes first to third ports. In the three-way switching valve (32), the first port is connected to a gas bypass pie (31*c*), the second port is connected to the suction pipe (31*b*) of the high pressure side compressor (31), the third port is connected to a gas communication pipe (31*d*). The three-way switching valve (32) is exchanged between a state in which the first and third ports communicate with each other and a state in which the second and third ports communicate with each other. The gas bypass pipe (31*c*) is connected in the middle of the discharge pipe (31*a*) of the high pressure side compressor (31). The gas communication pipe (31*d*) is connected to the first communication pipe (11) extending from the outdoor unit (20). In this optional unit (30), the discharge pipe (31*a*) and the suction pipe (31*b*) of the high pressure side compressor (31) and the gas communication pipe (31*d*) form a gas line (3G).

The gas-liquid separator (33) separates refrigerant in a gas-liquid two-phase state into liquid refrigerant and gas refrigerant. Specifically, the gas-liquid separator (33) is composed of a cylindrical hermetic container, of which lower part forms a liquid refrigerant retainer and of which upper part forms a gas refrigerant retainer.

To the gas-liquid separator (33), a liquid flow-in pipe (33*a*) and a liquid flow-out pipe (33*b*) are connected, which pass through the body of the gas-liquid separator (33) and face the liquid refrigerant retainer. The liquid flow-in pipe (33*a*) is connected to the fourth communication pipe (14) extending from the indoor unit (40) while the liquid flow-out pipe (33*b*) is connected to the second communication pipe (12) extending from the outdoor unit (20). A liquid bypass pipe (33*d*) is connected between the liquid flow-in pipe (33*a*) and the liquid flow-out pipe (33*b*). In the optional unit (30), the liquid flow-in pipe (33*a*) and the liquid flow-out pipe (33*b*) form a liquid line (3L).

A gas flow-out pipe (33*c*) is connected to the gas-liquid separator (33) so as to pass through the top of the gas-liquid separator (33) and so as to face the gas refrigerant retainer. The gas flow-out pipe (33*c*) is connected in the middle of the suction pipe (21*b*) of the high pressure side compressor (31).

The optional unit expansion valve (34) is provided at a part of the liquid flow-in pipe (33*a*) which is located on the gas-liquid separator (33) side of the joint with the liquid bypass pipe (33*d*). The optional unit expansion valve (34) is composed of an electronic expansion valve of which opening is adjustable.

Solenoid valves as on/off valves and check valves for restricting the refrigerant flow are provided in the optional unit (30). Specifically, a first solenoid valve (SV-1) is provided in the liquid bypass pipe (33*d*). A first check valve (CV-1) is provided in the liquid flow-out pipe (33*b*), and a second check valve (CV-2) is provided at a part of the discharge pipe (31*a*) of the high pressure side compressor (31) which is located on the high pressure side compressor (31) side of the joint with the gas bypass pipe (31*c*). The check valves (CV-1, CV-2) allow the refrigerant to flow only in the direction indicated by the arrows in FIG. 1.

The optional unit (30) further includes an injection pipe (36) as one of the features of the present invention.

The injection pipe (36) is connected at one end as an inflow end thereof to the discharge pipe (31*a*) between the high pressure side compressor (31) and the second check valve (CV-2) while being connected at the other end as an outflow end thereof to the suction pipe (31*b*) between the high pressure side compressor (31) and the gas flow-out pipe (33*c*). A third solenoid valve (SV-3) as an on/off valve and a capillary tube (37) are provided in this order from the inflow end side in the injection pipe (36).

The injection pipe (36) is so composed to inject the gas refrigerant discharged from the high pressure side compressor (31) into the suction side of the high pressure side compressor (31) in the defrosting operation. Whereby, the thus injected discharged gas refrigerant heats the refrigerant in the gas-liquid two-phase state from the gas-liquid separator (33) through the flow-out pipe (33*c*), which is sucked up by the high pressure side compressor (31), in the defrosting operation.

—Driving Operation—

Driving operations of the air conditioner (10) in accordance with Embodiment 1 will be described next.

<Cooling Operation>

Figure 2:
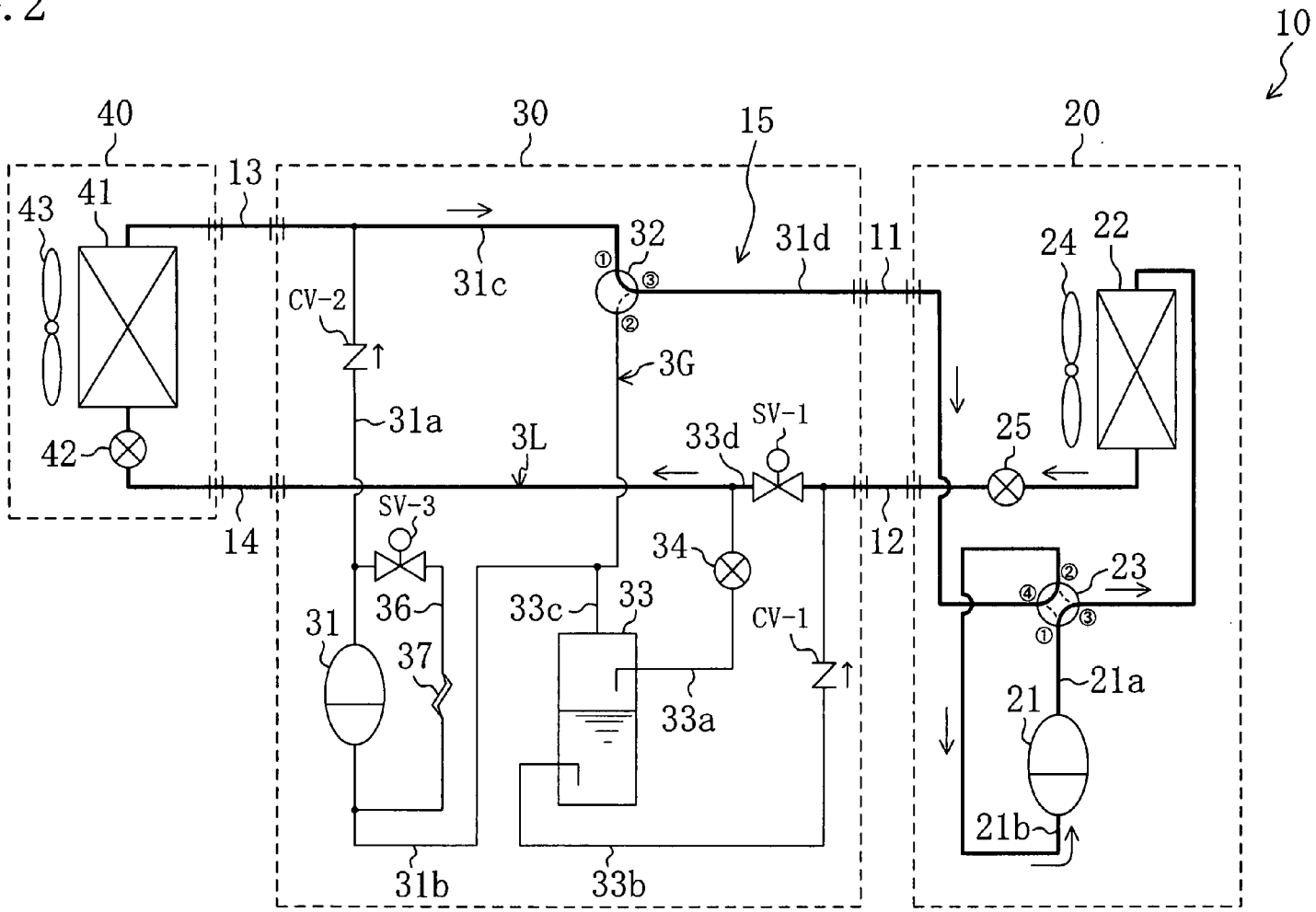
FIG. 2 is a refrigerant circuit diagram showing a cooling operation of the air conditioner in accordance with Embodiment 1.

In the cooling operation, the four-way switching valve (23) and the three-way switching valve (32) are set as shown in FIG. 2 and the first solenoid valve (SV-1) is opened while the third solenoid valve (SV-3) is closed. Further, the outdoor unit expansion valve (25) is opened fully while the optional unit expansion valve (34) is closed fully. The opening of the indoor unit expansion valve (42) is adjusted appropriately according to the driving condition. Further, in the cooling operation, the low pressure side compressor (21) is driven while the high pressure side compressor (31) is stopped. Namely, during the cooling operation, the refrigerant is compressed only in the low pressure side compressor (21) so that a single-stage compression refrigeration cycle is performed in the refrigerant circuit (15).

The high-pressure refrigerant discharged from the low pressure side compressor (21) of the outdoor unit (20) flows into the outdoor heat exchanger (22). In the outdoor heat exchanger (22), the high-pressure refrigerant releases heat to the outdoor air to be condensed. The refrigerant thus condensed in the outdoor heat exchanger (22) is sent to the indoor unit (40) via the flow-out pipe (33*b*), the liquid bypass pipe (33*d*), and the liquid flow-in pipe (33*a*) of the optional unit (30). In other words, the refrigerant flowing in the optional unit (30) bypasses the gas-liquid separator (33) in flowing into the liquid line (3L).

The refrigerant flowing in the indoor unit (40) is reduced in pressure up to low pressure through the indoor unit expansion valve (42). The low-pressure refrigerant after being subjected to pressure reduction flows into the indoor heat exchanger (41) and absorbs heat from the indoor air to be evaporated. As a result, the indoor air is cooled, which means performance of indoor cooling. The refrigerant evaporated in the indoor heat exchanger (41) is sent to the outdoor unit (20) via the discharge pipe (31*a*), the gas bypass pipe (31*c*), and the gas communication pipe (31*d*) of the optional unit (30). The refrigerant flowing into the outdoor unit (20) is sucked into the low pressure side compressor (21).

<Heating Operation>

Figure 3:
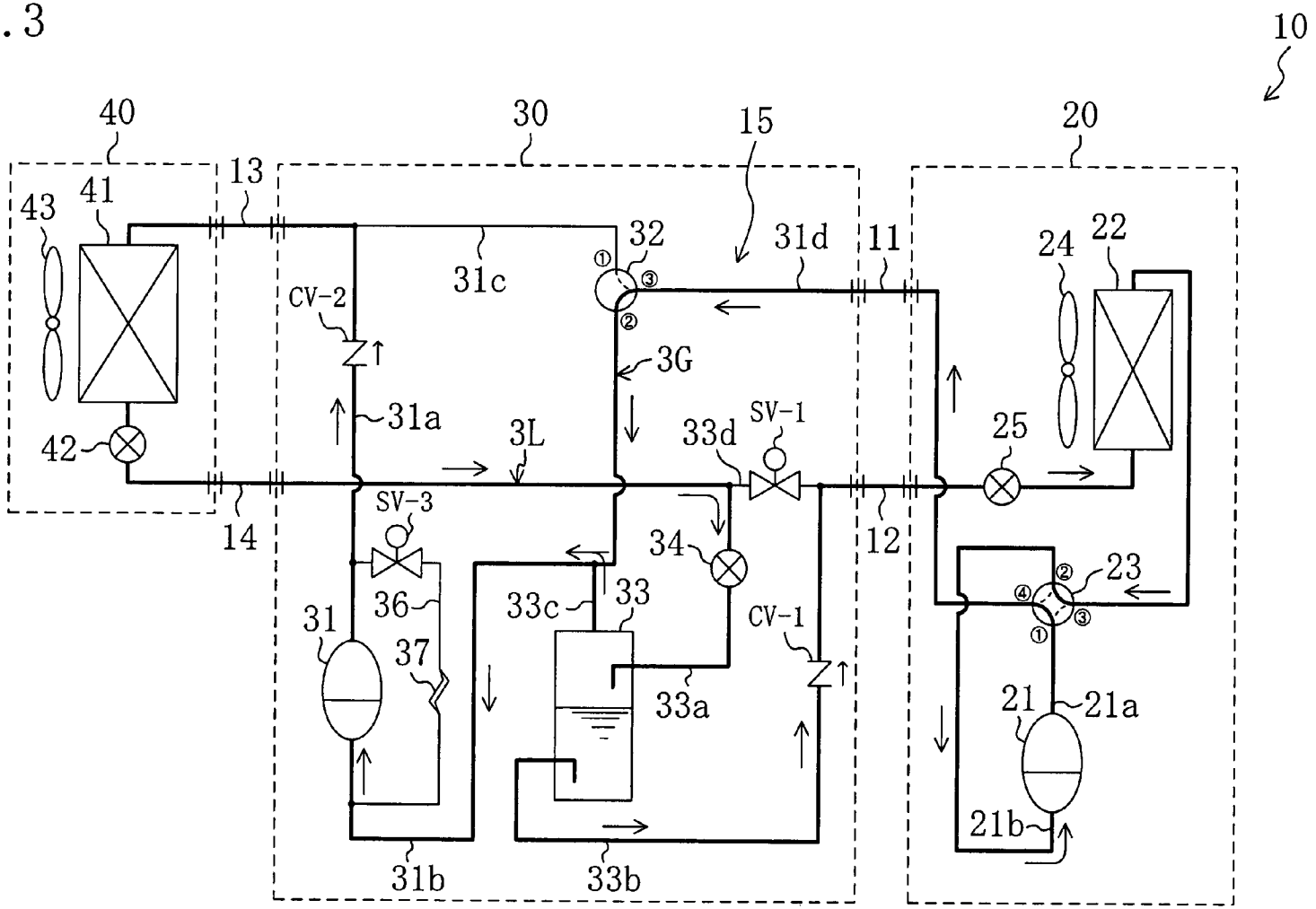
FIG. 3 is a refrigerant circuit diagram showing a heating operation of the air conditioner in accordance with Embodiment 1.

In the heating operation, the four-way switching valve (23) and the three-way switching valve (32) are set as shown in FIG. 3 and the first solenoid valve (SV-1) and the third solenoid valve (SV-3) are closed. Further, each opening of the indoor unit expansion valve (42), the optional unit expansion valve (34), and the outdoor unit expansion valve (25) is adjusted appropriately according to the driving condition. Further, in the heating operation, both the low pressure side compressor (21) and the high pressure side compressor (31) are driven.

The high-pressure refrigerant discharged from the high pressure side compressor (31) of the optional unit (30) flows into the indoor heat exchanger (41) of the indoor unit (40). In the indoor heat exchanger (41), the high-pressure refrigerant releases heat to the indoor air to be condensed. As a result, the indoor air is heated, which means performance of indoor heating. The refrigerant thus condensed in the indoor heat exchanger (41) is reduced in pressure through the indoor unit expansion valve (42), flows into the liquid flow-in pipe (33*a*) of the optional unit (30), is further reduced in pressure through the optional unit expansion valve (34) to be intermediate-pressure refrigerant, and flows then into the gas-liquid separator (33).

In the gas-liquid separator (33), the intermediate-pressure refrigerant in a gas/liquid two-phase state is separated into the gas refrigerant and the liquid refrigerant. The thus separated gas refrigerant in a saturated state flows into the suction side of the high pressure side compressor (31) through the gas flow-out pipe (33*c*). On the other hand, the separated liquid refrigerant is sent from the liquid flow-out pipe (33*b*) to the outdoor unit (20). The refrigerant thus flowing into the outdoor unit (20) is reduced in pressure up to low pressure through the outdoor unit expansion valve (25). The low-pressure refrigerant flows into the outdoor heat exchanger (22) and absorbs heat from the outdoor air to be evaporated. The refrigerant thus evaporated in the outdoor heat exchanger (22) is sucked into the low pressure side compressor (21).

In the low pressure side compressor (21), the low-pressure refrigerant is compressed to be intermediate-pressure refrigerant. The intermediate-pressure refrigerant is sent to the optional unit (30) again. The refrigerant flowing in the optional unit (30) flows into the suction pipe (31*b*) of the high pressure side compressor (31) through the gas communication pipe (31*d*) and the three-way switching valve (32), is merged with the gas refrigerant from the gas flow-out pipe (33*c*), and is then sucked into the high pressure side compressor (31).

As described above, in the heating operation, the two-state compression/two-stage expansion refrigeration cycle is performed in which the high-pressure refrigerant is expanded (reduced in pressure) in two stages while the low-pressure refrigerant is compressed in two stages. Further, in this heating operation, the intermediate-pressure refrigerant in the gas-liquid two-phase state is separated into the gas refrigerant and the liquid refrigerant in the gas-liquid separator (33) so that the gas refrigerant after separation is returned to the high pressure side compressor (31). As a result, only the liquid refrigerant is sent to the outdoor heat exchanger (22), so that the pressure loss in the liquid pipes from the gas-liquid separator (33) to the outdoor heat exchanger (22) reduces and a generally-called flashing phenomenon that part of the liquid refrigerant evaporates is suppressed.

Further, since the gas refrigerant separated in the gas-liquid separator (33) is sent neither to the outdoor heat exchanger (22) nor to the low pressure side compressor (21), the gas refrigerant is not compressed in the low pressure side compressor (21) to reduce the work load of the compressors as a whole. As a result, the COP of the air conditioner (10) increases. In addition, the high pressure side compressor (31) is allowed to suck the intermediate-pressure gas refrigerant separated in the gas-liquid separator (33), thereby cooling the refrigerant sucked in the high pressure side compressor (31). As a result, abnormal temperature increase of the refrigerant discharged is avoided in the high pressure side compressor (31).

<Defrosting Operation>

The defrosting operation is performed for removing frost when the outdoor heat exchanger (22) is frosted in the heating operation. The defrosting operation in the present embodiment is generally called a reverse cycle defrosting operation in which the refrigerant flows in a direction reverse to that in the heating operation. The defrosting operation is exchanged between a first defrosting operation and a second defrosting operation. In the first defrosting operation, only the low pressure side compressor (21) is driven with the high pressure side compressor (31) stopped. While in the second defrosting operation, both the high pressure side compressor (31) and the low pressure side compressor (21) are driven.

First referring to the first defrosting operation, the four-way switching valve (23), the three-way switching valve (32), the first solenoid valve (SV-1), and the like are set as shown in FIG. 2, similarly to the aforementioned cooling operation. When the low pressure side compressor (21) is driven, the refrigerant flows similarly to that in the cooling operation. Namely, the high-temperature refrigerant discharged from the low pressure side compressor (21) flows into the outdoor heat exchanger (22). In the outdoor heat exchanger (22), the high-temperature refrigerant removes the frost.

Figure 4:
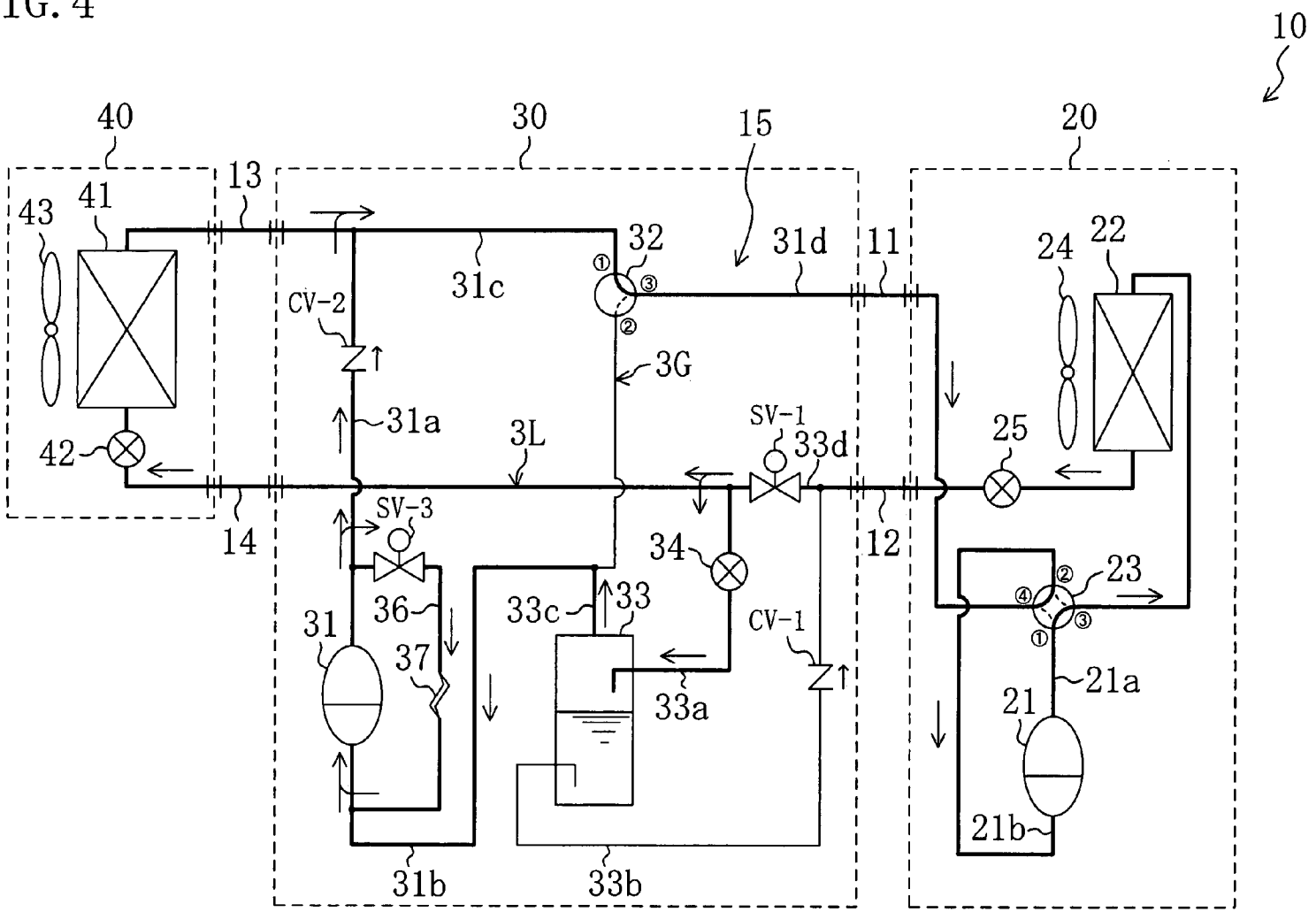
FIG. 4 is a refrigerant circuit diagram showing a defrosting operation of the air conditioner in accordance with Embodiment 1.

In the second defrosting operation, the four-way switching valve (23) and the three-way switching valve (32) are set as shown in FIG. 4, and the first solenoid valve (SV-1) and the third solenoid valve (SV-3) are opened. Further, the outdoor unit expansion valve (25) and the optional unit expansion valve (34) are opened fully while the opening of the indoor unit expansion valve (42) is set at a predetermined degree. In other words, during the second defrosting operation, the third solenoid valve (SV-3) and the optional unit expansion valve (34) are opened fully in the state of the refrigerant circuit (15) in the first defrosting operation. In this state, the low pressure side compressor (21) and the high pressure side compressor (31) are driven.

The refrigerant discharged from the low pressure side compressor (21) flows into the outdoor heat exchanger (22) for defrosting and flows then into the liquid flow-in pipe (33*a*) of the optional unit (30). Of this refrigerant, part flows into the indoor unit (40) while the other flows into the gas-liquid separator (33).

The refrigerant flowing in the indoor unit (40) passes through the indoor heat exchanger (41) and is then sent to the outdoor unit (20) via the discharge pipe (31*a*), the gas bypass pipe (31*c*), and the gas communication pipe (31*d*) of the optional unit (30). The refrigerant flowing in the outdoor unit (20) is sucked into the low pressure side compressor (21). The refrigerant flowing in the gas-liquid separator (33) is separated into the gas refrigerant and the liquid refrigerant. The thus separated gas refrigerant flows into the suction pipe (31*b*) of the high pressure side compressor (31) through the gas flow-out pipe (33*c*).

On the other hand, of the refrigerant discharged from the high pressure side compressor (31), part is merged with the refrigerant from the indoor unit (40) in the gas bypass pipe (31*c*) while the other flows into the injection pipe (36). The refrigerant merged in the gas bypass pipe (31*c*) is sucked into the low pressure side compressor (21) as described above. The thus sucked refrigerant has an enthalpy larger by the work load (heat input) of the high pressure side compressor (31) than the refrigerant sucked as in the first defrosting operation. Accordingly, the enthalpy of the refrigerant discharged from the low pressure side compressor (21) increases to increase the defrosting capacity of the outdoor heat exchanger (22).

The high-temperature refrigerant flowing in the injection pipe (36) passes through the capillary tube (37), is merged with the gas refrigerant from the gas-liquid separator (33) at the suction pipe (31*b*), and is then sucked into the high pressure side compressor (31). Herein, not only the gas refrigerant but also the liquid refrigerant may flow out from the gas-liquid separator (33) into the suction pipe (31*b*). Even if so, the liquid refrigerant flowing out into the suction pipe (31*b*) is mixed with the high-temperature refrigerant from the injection pipe (36) to be gasified. Accordingly, the liquid refrigerant is prevented from flowing into the high pressure side compressor (31) to avoid damage to the high pressure side compressor (31).

Effects of Embodiment 1

The optional unit (30) in the present embodiment includes the high pressure side compressor (31) that sucks the refrigerant from the gas-liquid separator (33) and allows its discharged refrigerant to be mixed with the refrigerant to be sucked into the low pressure side compressor (21) in the defrosting operation, the injection pipe (36) is provided for injecting part of the refrigerant discharged from the high pressure side compressor (31) into the suction side thereof. Accordingly, even if the liquid refrigerant from the gas-liquid separator (33) flows out into the suction side of the high pressure side compressor (31), the liquid refrigerant can be gasified by the high-temperature gas refrigerant from the injection pipe (36). This prevents the liquid refrigerant from flowing into the high pressure side compressor (31) to avoid damage to the high pressure side compressor (31).

On the other hand, part of the refrigerant discharged from the high pressure side compressor (31) is mixed with the refrigerant to be sucked into the low pressure side compressor (21), which increases the enthalpy of the refrigerant sucked in the low pressure side compressor (21). This increases the enthalpy of the refrigerant discharged from the low pressure side compressor (21) to increase the defrosting capacity of the outdoor heat exchanger (22). In short, according to the present embodiment, the high pressure side compressor (31) can be driven in the defrosting operation with damage thereof avoided when compared with the conventional case, thereby increasing the defrosting capacity with no loss of the reliability of the apparatus involved.

Embodiment 2

Figure 5:
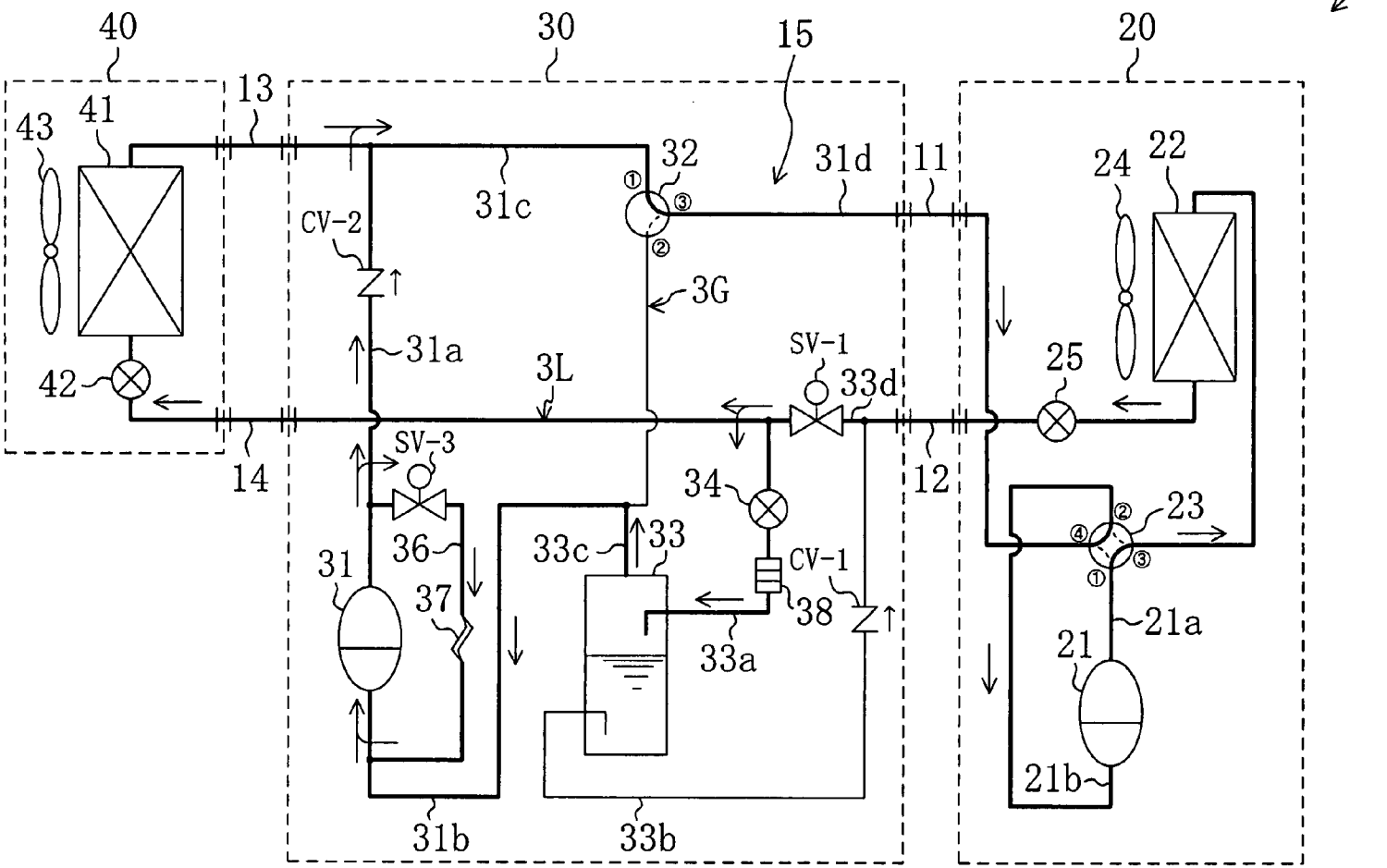
FIG. 5 is a refrigerant circuit diagram showing a defrosting operation of an air conditioner in accordance with Embodiment 2.

A refrigerating apparatus in accordance with Embodiment 2 is an air conditioner according to Embodiment 1, of which the optional unit (30) includes a piping heater (38), as shown in FIG. 5.

Specifically, the piping heater (38) is provided at a part of the liquid flow-in pipe (33*a*) which is located on the gas-liquid separator (33) side of the optional unit expansion valve (34). The piping heater (38) composes heating means for heating the refrigerant flowing into the liquid flow-in pipe (33*a*) in the second defrosting operation.

In this case, the liquid refrigerant flowing into the liquid flow-in pipe (33*a*) from the outdoor unit (20) and branching into the gas-liquid separator (33) is heated by the piping heater (38) in the second defrosting operation to be the refrigerant in the gas-liquid two-phase state. The refrigerant in the gas-liquid two-phase state flows into the gas-liquid separator (33). This increases the amount ratio of the gas refrigerant to the liquid refrigerant in the gas-liquid separator (33) to suppress outflow of the liquid refrigerant from the gas-liquid separator (33) into the suction pipe (31*b*) of the high pressure side compressor (31). As a result, the liquid refrigerant is prevented definitely from flowing into the high pressure side compressor (31). The other features, operation, and effects are the same as those in Embodiment 1.

Modified Example 1 of Embodiment 2

Figure 6:
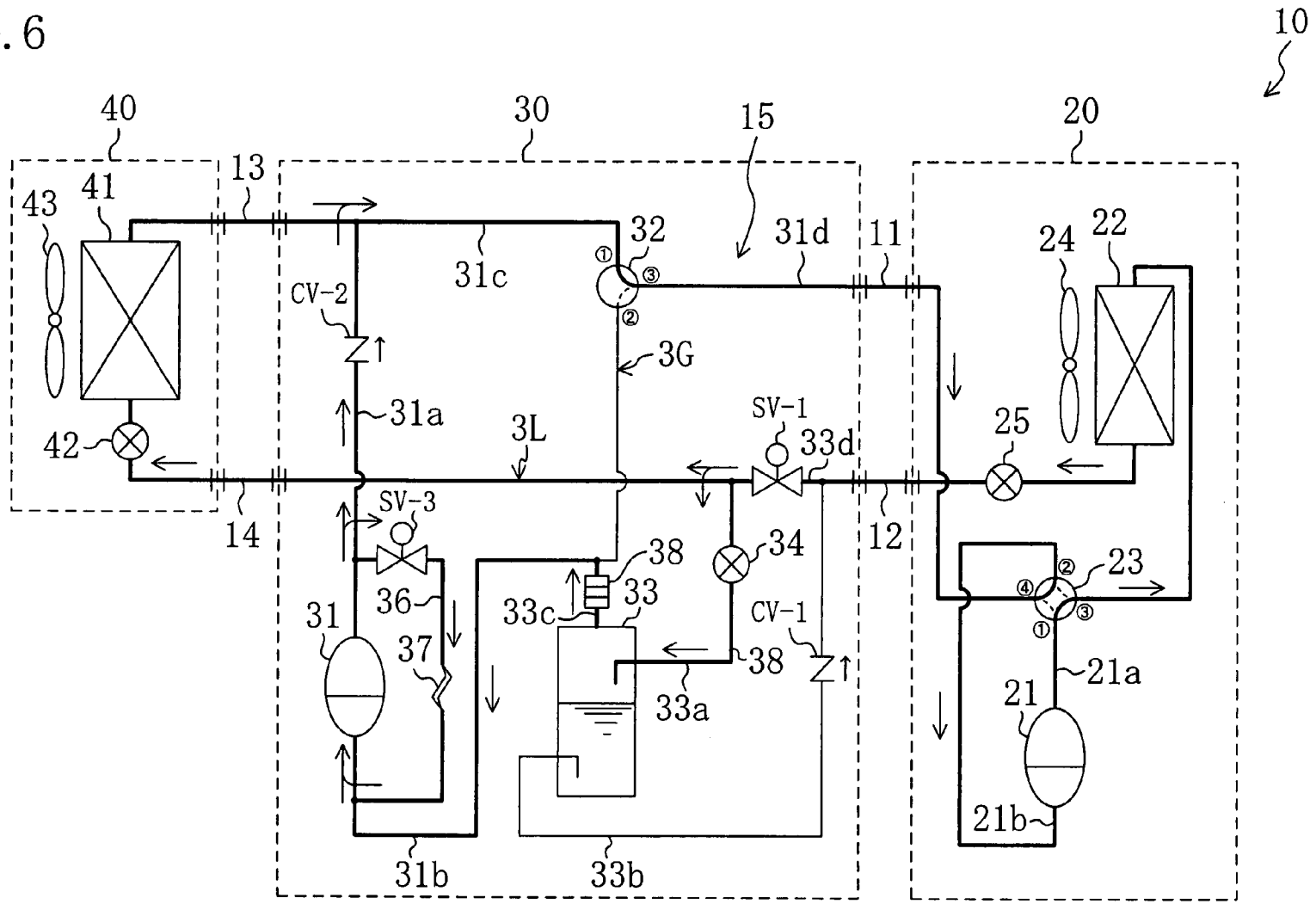
FIG. 6 is a refrigerant circuit diagram showing a defrosting operation of an air conditioner in accordance with Modified Example 1 of Embodiment 2.

Modified Example 1 is the case where the piping heater (38) is provided at a point different from that in embodiment 2, as shown in FIG. 6. Specifically, in the present modified example, the piping heater (38) is provided in the middle of the gas flow-out pipe (33*c*).

In this case, during the second defrosting operation, the refrigerant flowing out into the gas flow-out pipe (33*c*) from the gas-liquid separator (33) is heated by the piping heater (38) and flows then into the suction pipe (31*b*) of the high pressure side compressor (31). Accordingly, even the liquid refrigerant flowing out from the gas-liquid separator (33) is heated by the piping heater (38) to be the refrigerant in the gas-liquid two-phase state and is then mixed with the high-temperature refrigerant from the injection pipe (36). Whereby, the liquid refrigerant from the gas-liquid separator (33) is gasified definitely and is then sucked into the high pressure side compressor (31).

Modified Example 2 of Embodiment 2

Figure 7:
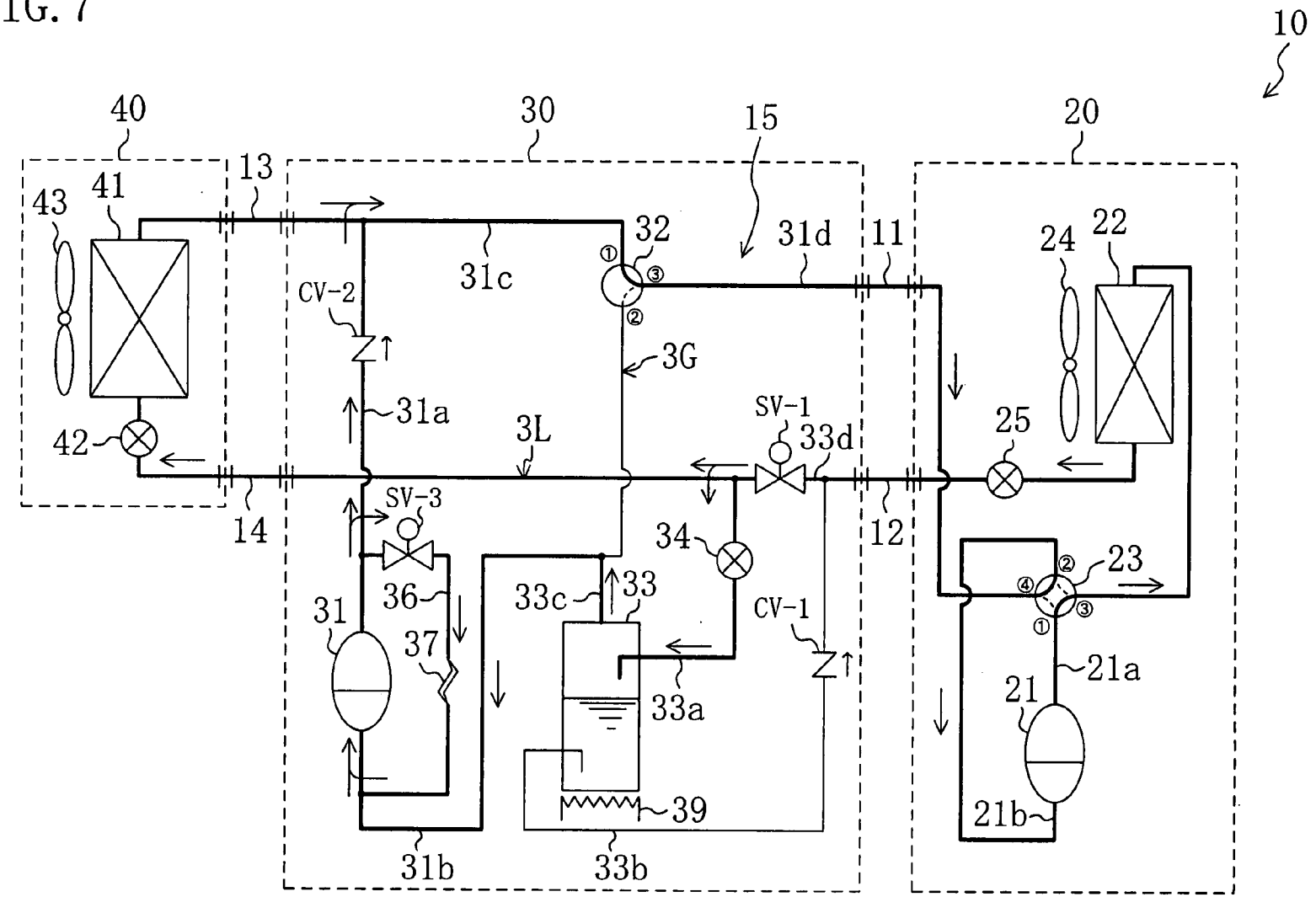
FIG. 7 is a refrigerant circuit diagram showing a defrosting operation of an air conditioner in accordance with Modified Example 2 of Embodiment 2.

In Modified Example 2, a gas-liquid separator heater (39) is provided rather than the piping heater (38) in the Embodiment 2, as shown in FIG. 7. Specifically, the gas-liquid separator heater (39) is provided at the gas-liquid separator (33) to serve as heating means for heating the refrigerant in the gas-liquid separator (33).

In this case, the refrigerant in the gas-liquid separator (33) is heated in the second defrosting operation to gasify part of the liquid refrigerant in the gas-liquid separator (33). This increases the amount ratio of the gas refrigerant to the liquid refrigerant in the gas-liquid separator (33) to suppress outflow of the liquid refrigerant from the gas-liquid separator (33). As a result, the liquid refrigerant is definitely prevented from flowing into the high pressure side compressor (31).

Modified Example 3 of Embodiment 2

Figure 8:
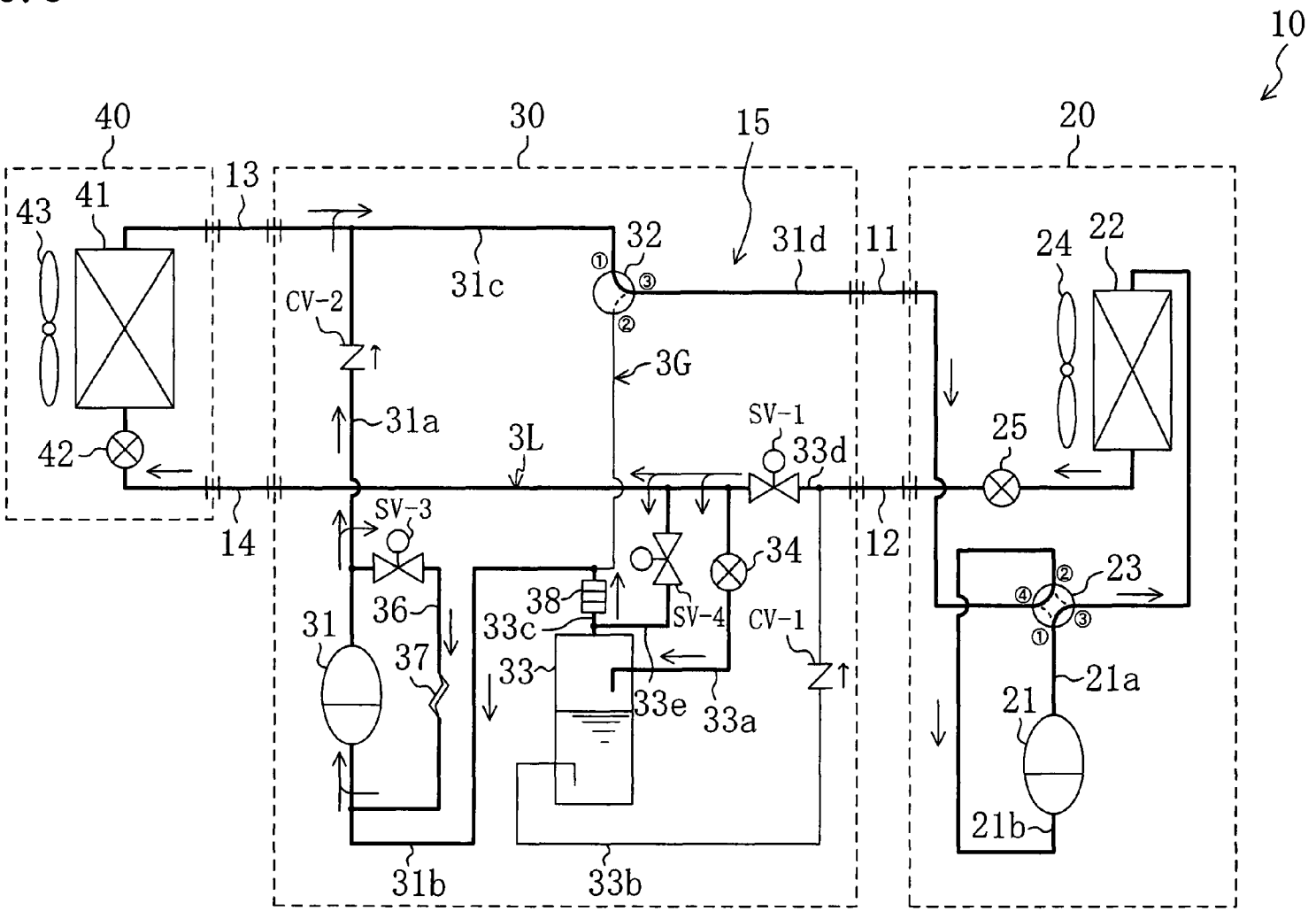
FIG. 8 is a refrigerant circuit diagram showing a defrosting operation of an air conditioner in accordance with Modified Example 3 of Embodiment 2.

In Modified Example 3, a liquid branch pipe (33*e*) is provided in the optional unit (30) in Modified Example 2 of Embodiment 2, as shown in FIG. 8. Specifically, the liquid branch pipe (33*e*) is connected at one end as an inflow end thereof to a part of the liquid flow-in pipe (33*a*) which is located on the indoor unit (40) side of the optional unit expansion valve (34) while being connected at the other end as an outflow end thereof to a part of the gas flow-out pipe (33*c*) which is located on the gas-liquid separator (33) side of the piping heater (38). A fourth solenoid valve (SV-4) as an on/off valve is provided in the liquid branch pipe (33*e*). The fourth solenoid valve (SV-4) is opened only during the second defrosting operation.

In the present modified example, in the second defrosting operation, part of the refrigerant flowing into the liquid flow-in pipe (33*a*) from the liquid bypass pipe (33*d*) and flowing toward the indoor unit (40) flows into the liquid branch pipe (33*e*). While on the other hand, the other refrigerant flows into the indoor unit (40). The refrigerant flowing in the liquid branch pipe (33*e*) is merged with the refrigerant from the gas-liquid separator (33) at the gas flow-out pipe (33*c*), is heated in the piping heater (38), and flows then into the suction pipe (31*b*).

In this case, the amount of the refrigerant flowing into the indoor heat exchanger (41) decreases to increase the temperature of the refrigerant in the indoor heat exchanger (41). Further, the refrigerant flowing in the gas-liquid branch pipe (33*e*) is also heated to increase in temperature, so that the temperature of the refrigerant sucked into the high pressure side compressor (31) increases to increase the temperature of the refrigerant discharged therefrom. Whereby, the temperature of the refrigerant sucked into the low pressure side compressor (21) increases to increase the temperature of the refrigerant discharged therefrom. As a result, the defrosting capacity of the outdoor heat exchanger (22) increases.

Other Embodiments

In the above embodiments, refrigerant other than carbon dioxide may be used, of course.

Each of the above embodiments is applied to an air conditioner, but the refrigerating apparatus in accordance with the present invention may be applied to, for example, hot water suppliers generating hot water by heat exchange between refrigerant and water in a user side heat exchanger and the like.

It should be noted that the above embodiments are mere essentially preferable examples of the present invention and is not intended to limit the present invention, applicable objects, ranges of uses thereof.

INDUSTRIAL APPLICABILITY

As described above, the present invention is useful for refrigerating apparatuses including an extended optional unit including a high pressure side compressor and an intermediate-pressure refrigerant gas-liquid separator.

The invention claimed is:

1. A refrigerating apparatus comprising a refrigerant circuit including a first compressor, a second compressor, and an intermediate-pressure refrigerant gas-liquid separator for performing a refrigeration cycle, said gas-liquid separator separating flowed-in refrigerant into a gas refrigerant and a liquid refrigerant, wherein the refrigerant circuit is switched from/to a heating cycle to/from a defrosting cycle, refrigerant being subjected to two-stage compression/two-stage expansion in the heating cycle in which refrigerant discharged from the first compressor is compressed in the second compressor, condensed refrigerant flows into the gas-liquid separator, and gas refrigerant in the gas-liquid separator is sucked into the second compressor, and in the defrosting cycle, part of the refrigerant discharged from the first compressor and then condensed flowing into the gas-liquid separator while both of the first compressor and the second compressor are operated, and the refrigerant circuit includes an injection pipe for injecting part of refrigerant discharged from the second compressor into a suction side of the second compressor in the defrosting cycle so as to merge the refrigerant with refrigerant from the gas-liquid separator.

2. A refrigerating apparatus comprising a refrigerant circuit including:

a heat source unit including a first compressor and a heat source side heat exchanger;

a user unit including a user side heat exchanger; and an intermediate unit including: a gas line in which a second compressor is provided and which is connected between the heat source unit and the user unit; and a liquid line in which an intermediate-pressure refrigerant gas-liquid separator connected to a suction side of the second compressor by means of a gas flow-out pipe is provided and which is connected between the heat source unit and the user unit, said gas-liquid separator separating flowed-in refrigerant into a gas refrigerant and a liquid refrigerant, the refrigerant circuit being switched between a heating cycle and a defrosting cycle, refrigerant being compressed in two stages in the heating cycle in a way that refrigerant discharged from the first compressor is compressed in the second compressor in the gas line, and liquid refrigerant from the user unit flows into the gas-liquid separator in the liquid line, and in the defrosting cycle, part of the refrigerant flowing into the heat source side heat exchanger from the first compressor flowing into the gas-liquid separator in the liquid line while both of the first compressor and the second compressor are operated, wherein the intermediate unit includes an injection pipe provided in the gas line for injecting part of refrigerant discharged from the second compressor between a suction side of the second compressor and the gas flow-out pipe in the defrosting cycle.

3. The refrigerating apparatus of claim 2, wherein the intermediate unit includes heating means in the liquid line for heating refrigerant flowing into the gas-liquid separator.

4. The refrigerating apparatus of claim 2, wherein the intermediate unit includes heating means in the gas flow-out pipe for heating refrigerant flowing out from the gas-liquid separator.

5. The refrigerating apparatus of claim 2, wherein the intermediate unit includes heating means at the gas-liquid separator for heating refrigerant in the gas-liquid separator.

6. The refrigerating apparatus of claim 4, wherein the intermediate unit includes a liquid branch pipe of which one end is connected to the liquid line and of which other end is connected to the gas flow-out pipe at a position that is upstream of the heating means.

7. The refrigerating apparatus of claim 1 or 2, wherein the refrigerant is carbon dioxide.

* * * * *